US007303693B2

(12) United States Patent
Fahl et al.

(10) Patent No.: US 7,303,693 B2
(45) Date of Patent: Dec. 4, 2007

(54) OPERATING MEDIUM FOR CARBON DIOXIDE-COOLING SYSTEMS AND AIR-CONDITIONING SYSTEMS

(75) Inventors: Jörg Fahl, Wolfsburg (DE); Jürgen Braun, Speyer (DE)

(73) Assignee: Fuchs Petrolub AG, Mannheim (DE)

( * ) Notice: Subject to any disclaimer, the term of this patent is extended or adjusted under 35 U.S.C. 154(b) by 268 days.

(21) Appl. No.: 10/500,629

(22) PCT Filed: Dec. 24, 2002

(86) PCT No.: PCT/DE02/04741

§ 371 (c)(1),
(2), (4) Date: Feb. 16, 2005

(87) PCT Pub. No.: WO03/057804

PCT Pub. Date: Jul. 17, 2003

(65) Prior Publication Data

US 2005/0127320 A1 Jun. 16, 2005

(30) Foreign Application Priority Data

Dec. 29, 2001 (DE) ..... 101 64 056

(51) Int. Cl.
*C09K 5/00* (2006.01)

(52) U.S. Cl. ..... 252/68; 508/405

(58) Field of Classification Search ..... None
See application file for complete search history.

(56) References Cited

U.S. PATENT DOCUMENTS 5,498,356 A * 3/1996 Kamakura et al. ..... 508/495
6,096,692 A * 8/2000 Hagihara et al. ..... 508/307
6,692,654 B2 * 2/2004 Osumi et al. ..... 252/68
6,849,583 B2 * 2/2005 Corr et al. ..... 508/405
2002/0007640 A1 * 1/2002 Corr et al. ..... 62/85

FOREIGN PATENT DOCUMENTS

| | | |
|---|---|---|
| EP | 1008643 | 6/2000 |
| EP | 1063279 | 12/2000 |
| EP | 1243639 | 9/2002 |
| WO | WO 93/06196 | 4/1993 |

OTHER PUBLICATIONS

D. Drees et al., "Effects of CO2 on lubricating properties of polyolesters and polyalkylene glycols," Int. Coll. Tribology Esslingen (Jan. 2002), 425-431, 13.

Jorg Fahl, "Esterole fur CO2-Kalte-und Klimasysteme," Kalte und Klimatechnik 53 (2000), pp. 478-481, 11, ISSN 0343-2246.

J. Fahl et al., "Polyalkylenether-Schmierstoffe fur CO2-Pkw-Klimaanlagen," Luft-und Kaltetechnik 36(2000), pp. 478-481, 10, ISSN 0945-0459.

* cited by examiner

*Primary Examiner*—Gregory Webb
(74) *Attorney, Agent, or Firm*—Hedman & Costigan, P.C.

(57) ABSTRACT

The invention relates to resource operating medium compositions containing additivated lubricants based on polyalkylene glycols and/or neopentyl polyol esters, which are additivated with alkylated triaryl phosphate esters which are suitable for lubricating refrigerators, air-conditioning systems, heat pumps and similar systems which are operated using carbon dioxide as an operating medium.

21 Claims, No Drawings

OPERATING MEDIUM FOR CARBON DIOXIDE-COOLING SYSTEMS AND AIR-CONDITIONING SYSTEMS

The invention relates to operating agent compositions comprising added lubricants based on polyalkylene glycols and/or neopentyl polyol esters suitable for lubricating refrigerating machines, air conditioning equipment, heat pumps and related equipment operated with carbon dioxide as refrigerant.

Carbon dioxide was used as an operating agent for refrigerating machines as early as at the beginning of modern cryo-engineering. Thus, Linde built the first compression refrigerating machine as early as in 1881 using carbon dioxide as refrigerant. Up to the middle of this century, carbon dioxide was used mainly in ship refrigerating equipment with sub-critical process controls. Glycerine was used as lubricant. Later on, following the introduction of fluorochlorohydrocarbon refrigerants, carbon dioxide was hardly used.

At present, the halogenated fluorohydrocarbon R134a is mainly used in motor vehicle air conditioning equipment and refrigerant mixtures such as R404A are used in frozen food equipment. The use of the old-established refrigerant carbon dioxide (R744) is being reconsidered in recent years on an increasing scale. Polyalkylene glycols (PAG) have already been suggested for use as lubricants in motor car air conditioning systems (compare e.g. 'Polyalkylenether-Schmierstoffe für $CO_2$-Pkw-Klima-Systeme'—polyalkylene ether lubricants for $CO_2$ motor car air conditioning systems, J. Fahl, E Weidner in Luft- and Kältetechnik 36 (2000) 10, page 478-481, ISSN 0945-0459). Polyol esters have been suggested for use in $CO_2$ frozen food equipment (compare e.g. Esteröle für $CO_2$-Kälte- und Klimasysteme—ester oils for $CO_2$ refrigerating and air conditioning systems, J Fahl in Kälte—and Klimatechnik 53 (2000) 11, page 38-45, ISSN 0343-2246).

The advantages of the natural working material carbon dioxide ($CO_2$) can be exploited in a trans-critical cyclic process; however, considerably higher operating pressures occur in this case than would correspond to the present state of the art. In such a cycle, the operating medium is present both in the sub-critical and in the super-critical state and previously unknown lubrication problems arise. On the one hand, almost complete miscibility between the lubricating oil and $CO_2$ is required at temperatures going as low −40° C.; on the other hand, corresponding lubrication and stability properties need to be guaranteed under the influence of $CO_2$ at pressures of up to 150 bar and temperatures of up to 220° C. In air conditioning equipment, in particular, the lubricating oil is subject to extreme mechanical and thermal stresses. Tribological difficulties occur in test compressors of the most varied types of design.

The main cause of compressor failure has initially been assumed to be the comparatively high $CO_2$-solubility in lubricating oil and the resulting dilution and degasification effects. Initial practical investigations in piston compressors operated at sub-critical level have shown that, in spite of maintaining the minimum required mixture viscosity, extreme wear phenomena occur as a result of the effect of $CO_2$ which phenomena are attributable to mixed friction and lack of lubrication. In the first prototype compressors of motor car air conditioning systems operated at the trans-critical level, lubrication problems were observed when commercial neopentyl polyol esters (POE) or polyalkylene glycol (PAG) oils were used.

Only oils of certain chemical compounds exhibit the necessary properties such as e.g. a correspondingly satisfactory cold flow behaviour and a favourable solubility with $CO_2$. Investigations have shown that the physical properties and the interactions between different basic oils and sub-critical and super-critical $CO_2$ depend to a large extent on their chemical composition. Mineral oils are almost immiscible with $CO_2$ and, as a result of the rather moderate high temperatures stability compared with synthesis oils, have proved to be hardly suitable. Because of their unfavourable phase behaviour and the comparatively low density, in particular, both hydrocracking oils and alkyl aromatics as well as polyalphaolefins (PAO) must be classified as unsuitable for use in systems with a battery on the intake side.

As a result of the comparatively high volumetric refrigeration output of $CO_2$ and the increased efficiency, cryogenic compressors can be dimensioned smaller for carbon dioxide. This requires a high load carrying capacity of the lubricant in the corresponding temperature range.

Practical experience has shown that polyalkylene glycols possess excellent friction properties. The satisfactory absorption to metal surfaces can be attributed to the polar character. As a result of this high surface activity and the low viscosity pressure dependence, low friction coefficients are achieved.

In the tribological contact areas subject to the influence of $CO_2$, special conditions are present. At the moment of start up and shut down, in particular, strong solubility-dependent effects occur which inhibit the formation of a sufficient lubrication film thus allowing the clearance filled by oil film to be washed out as a result of dissolved refrigerant, the washing out being caused, among other things, by the pressure equalisation and the changes in surface tension occurring. Wear measurements on prototype compressors of different design have shown, however, that the dilution and degasification effects described can be compensated for only to some extent by using correspondingly highly viscous oils. In this respect, sufficient oil recycling from the evaporator is not always guaranteed. Moreover, the investigations carried out with piston compressors operated at sub-critical level have indicated that, in spite of a sufficiently high mixture viscosity, an unusually high stress is present in the area of mixed friction is present. Since, in practical tribotechnological systems, a superimposition of the different elemental wear mechanisms usually occurs, the wear behaviour cannot be assessed theoretically but can be determined only experimentally by corresponding wear tests.

From the purely tribological point of view, only little $CO_2$ should dissolve in the refrigerating machine oil as far as possible. On the other hand, a satisfactory miscibility is required for oil recycling and the heat transfer in the cold cycle.

The invention is consequently based on the problem of adding lubricants for carbon dioxide refrigerants in a suitable manner such that the mixture of carbon dioxide and lubricant satisfies the following requirements, apart from those mentioned above:

- excellent lubrication properties and a high load carrying capacity
- optimal anti-seizure performance and mixed friction conditions
- excellent thermal and chemical stability.

For serious stress conditions in cryogenic $CO_2$ compressors, the persons skilled in the art has access to the use of standard known anti-wear additives and/or high pressure additives. The anti-wear additives generally used in the lubricant sector are based on organometal compounds such as zinc/phosphorus or zinc/sulphur compounds such as zinc dithiophosphate (ZDTP). The usual active, low ash agents, on the other hand, comprise no metallic elements and consist e.g. of organic monosulphides and polysulphides, saturated and unsaturated fatty acids, natural and synthetic fatty esters and primary and secondary alcohols.

Surprisingly enough, certain additives and basic oil combinations have proved suitable for solving the above-mention tasks:

Operating agent compositions for refrigerating machines, heat pumps and allied equipment such as air conditioning equipment comprising (A) Carbon dioxide as refrigerant, the refrigerant preferably consisting essentially exclusively of carbon dioxide, (B) A polyalkylene glycol and/or a neopentyl polyol ester as lubricant and (C) A phosphate ester with the following structure as additive:

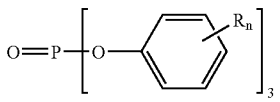

wherein

R optionally, identically or differently for each of the three phenyl moieties and optionally, identically or differently for each n, represents H or one or more C1 to C6 hydrocarbon moieties and n optionally identically or differently for each of the three phenyl moieties represents an integer of 1 to 5, preferably 1, 2 or 3 with the proviso that for at least one of the three phenyl moieties R is a C2 to C6 hydrocarbon preferably t-butyl and/or isopropyl.

Preferred embodiments of the above operating agent composition are the subject matter of the sub-claims and/or will be explained in the following.

Additives

The phosphate ester tricresyl phosphate which is known as a lubricant additive is not a subject matter of the invention (compare Tables 2 and 3, and the reference example). Tricresyl phosphate is a mixture of phosphates ortho-substituted, para-substituted or meta-monomethyl substituted at the phenyl ring.

The phosphate ester used according to the invention is preferably used in a quantity of 0.1 to 3% by weight, particularly preferably 0.3 to 1.5% by weight, based on the lubricant.

T-butylated triphenyl phosphates are usually produced by the alkylation of phenols and reaction with phosphoric acid trichloride. According to a preferred variation, the phosphate esters used according to the invention exhibit at least one phenyl moiety alkylated in the ortho-position.

In comparison with additives with added sulphur or chlorinated additives, the claimed triaryl phosphates are less reactive and have the advantage that they cause neither corrosion nor discolouration in the case of most metals. Moreover, these active substances highly soluble in the claimed basic oils are characterised by their extraordinarily high thermal and oxidative stability.

In contrast to anti-wear additives comprising sulphur and zinc, the claimed phosphates are considerably more stable under the influence of $CO_2$ and allow high application temperatures to be used. In particular, t-butylated triphyl phosphates are characterised by a very high hydrolytic stability.

Polyalkylene Glycols

The polyalkylene glycols (PAG) used according to the invention exhibit alkylene oxide units with 1 to 6 carbon atoms (—R—O—) as monomer units.

The polyalkylene glycols exhibit hydrogen end groups, alkyl, aryl, alkylaryl, aryloxy, alkoxy, alkylaruloxy and/or hydroxy end groups. Alkylaryloxy groups should also be understood to mean arylalkyl (ene)oxy groups and alkylaryl groups to mean arylalkyl(ene) groups (e.g. aryl $CH_2CH_2$—). The end groups of the alkyl type, including the alkoxy type, or of the aryl types, including the alkylaryl type, aryloxy type and alkylaryloxy type preferably exhibit 6 to 24 carbon atoms, particularly preferably 6 to 18 carbon atoms, based on the aryl types, and preferably 1 to 12 carbon atoms, based on the alkyl types.

The polyalkylene glycols according to the invention are consequently either homopolymers, namely polypropylene glycol (and/or polypropylene oxide) or copolymers, terpolymers etc. For the latter cases, the monomer units may exhibit a random distribution or a block structure. If the polyalkylene glycols are not homopolymers, preferably at least 20%, preferably at least 40% of all monomer units are producible from polypropylene oxide (PO), and also preferably, at least 20% of all monomer units of these polyalkylene glycols are producible by using ethylene oxide (EO) (PO/EO copolymers).

According to a further embodiment, preferably at least 20%, preferably at least 40% of all monomer units are producible from butylene oxide (BO) and, moreover, preferably at least 20% of all monomer units of these polyalkylene glycols are producible by using ethylene oxide (BO/EO copolymers).

When (poly)alcohols are used, the starting compound is incorporated into the polymer and, according to the meaning of the invention, also referred to as end group of the polymer chain. Suitable starting groups consist of compounds comprising active hydrogen such as e.g. n-butanol, propylene glycol, ethylene glycol, neopentyl glycols such as pentaerythritol, ethylene diamine, phenol, cresol or other (C1 to C16 (mono, di or tri)alkyl) aromatics, (hydroxyalkyl) aromatics, hydroquinone, aminoethanolamines, triethylenetetramines, polyamines, sorbitol or other sugars. Other C—H acidic compounds such as carboxylic acids or carboxylic anhydrides can also be used as starting compounds.

Preferably, the polyalkylene glycols comprise aryl groups or corresponding heteroaromatic groups, e.g. inserted into the polymer chain, as side groups or end groups; the groups may, if necessary, be substituted with linear or branched alkyl groups or alkylene groups, the alkyl groups or alkylene groups overall exhibiting preferably 1 to 18 carbon atoms. Suitable polyalkylene glycols are possibly producible by using the corresponding starting alcohol compounds, e.g. of the following type:

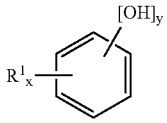

in which x and y represent an integer of 0 to 6, x+y is less than 7, x+y is more than 1 and y is either greater than 0 (preferably 1 to 3) or $R^1$ carries one or several hydroxy groups. It is also possible for y to be greater than 0 and $R^1$ to carry one or several hydroxy groups simultaneously. Preferably, y is an integer of 1 to 3. $R^1$ represents a linear or branched $C^1$ to C18 hydrocarbon group which, if necessary, carries one or several hydroxy groups. The starting alcohol compound may also, in the same way, consist of a condensed aromatic such as naphthalene instead of benzene.

Cyclic ether alcohols such as hydroxyfurfuryl or hydroxytetrahydrofuran, nitrogen heterocyclics or sulphur heterocyclics can also be used as starting groups. Such polyalkylene glycols are disclosed in WO 01/57164 which is herewith also made part of the subject matter of this application.

Preferably, the polyalkylene glycols according to the invention have an average molecular weight (number average) of 200 to 3000 g/mole, particularly preferably 400 to 2000 g/mole. The kinematic viscosity of the polyalkylene glycols is preferably 10 to 400 $mm^2/s$ (cSt) measured at 40° C. according to DIN 51562.

The polyalkylene glycols used according to the invention can be produced by reacting alcohols, including polyalcohols, as starting compounds with oxiranes such as ethylene oxide, propylene oxide and/or butylene oxide. Following the reaction, these possess only one free hydroxy group as end group. Polyalkylene glycols with only one hydroxy group are preferred over those with two free hydroxy groups. Polyalkylene glycols which, e.g. after a further etherification step, comprise no free hydroxy groups any longer are particularly preferred regarding the stability, hygroscopicity and compatibility. The alkylation of terminal hydroxyl groups leads to an increase in the thermal stability and an improvement in the $CO_2$ miscibility.

By selecting suitable end groups, the miscibility can, moreover, be adjusted in such a way that, in the phase diagram of T against a portion of lubricant in $CO_2$, areas of complete miscibility exist and those with no or only a slight miscibility.

Neopentyl Polyolesters and Lubricant Mixtures

It is also possible to use neopentyl polyolesters, if necessary together with the polyalkylene glycols described above, in the operating agents according to the invention.

The esters of neopentyl polyols such as neopentyl glycol, pentaerythritol and trimethylol propane with linear or branched C4 to C12 monocarboxylic acids, e.g. with addition of corresponding dicarboxylic acids are suitable neopentyl polyolesters. Usually, pentaerythritol is obtainable as technical grade pentaerythritol which is a mixture of monopentaerythritol, dipentaerythritol and tripentaerythritol. However, their condensation products such as dipentaerythritol and/or tripentaerythritol are also suitable as alcohol components.

Pentaerythritol or mixtures with dipentaerythritol and/or tripentaerythritol, preferably mixtures comprising predominantly dipentaerythritol are particularly suitable.

Complex esters can be produced by proportional esterification of polyhydric alcohols with monovalent and divalent acids such as $C_4$ to $C_{12}$ dicarboxylic acids. In this way, dimers and oligomers are formed. When using neopentyl glycol and/or trimethylol propane as alcohol group, complex esters are preferred.

In the test stand test described in the experimental part, the phosphoric acid esters used according to the invention have, surprisingly enough, proved to be excellent additives for improving the lubrication effect of the neopentyl polyol esters when used together with carbon dioxide as refrigerating machine operating agent, even when these neopentyl polyol esters are used as such, i.e. without using polyalkylene glycols. Neopentyl polyol esters have been regarded so far as being less suitable for use together with carbon dioxide as operating agent in refrigerating machines because of their less satisfactory lubrication properties—in comparison with polyalkylene glycols.

Compounds obtainable from neopentyl polyols and carboxylic acids are referred to as neopentyl polyol esters. Polyols not exhibiting hydrogen atoms in position β to the hydroxy group are referred to as neopentyl polyols. These are polyols with preferably 2 to 8 hydroxy groups, one, two or three quaternary carbon atoms and 5 to 21, preferably 5 to 15 carbon atoms, the hydroxy groups of the polyol, as alcohol component, being coupled only with those carbon atoms which, in turn, exhibit only quaternary carbon atoms in the vicinal position.

Examples of these are neopentyl polyol (NPG), trimethylol propane (TMP), pentaerythritol (PE). Neopentyl polyols as alcohol component may comprise, moreover, 1 to 4 ether bridges. The alcohol component pentaerythritol and/or dipentaerythritol (DPE) and/or tripentaerythritol (TPE) is particularly preferred.

Preferred acid components consist of n-pentanoic acid, n-heptanoic acid, octanoic acid, decanoic acid, 2-ethyl hexanoic acid, 3,5,5-trimethyl hexanoic acid and 2-hexyl decanoic acid as well as other Guerbet acids or their mixtures. To produce complex esters, adipic and dodecane dioic acid are particularly suitable. It has proved advantageous to produce the neopentyl polyol esters by reacting the corresponding alcohols with mixtures of the corresponding acids. The complete esterification of all hydroxy groups of the neopentyl polyols and acid groups of the dicarboxylic acids, which may be used if necessary, is preferred.

According to a further variant of the invention, the polyalkylene glycols used according to the invention can be employed together with neopentyl polyol esters as lubricants. Regarding the definition of the preferred alcohol groups of these neopentyl polyol esters, reference should be made to the above paragraphs.

Further Additives

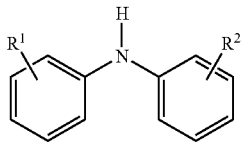

As further additives, di-phenyl amine and di(C1 to C16 alkyl)penyl amines, e.g. octylated/butylated di-phenyl amine, are particularly suitable as anti-oxidants.

Instead of substituted phenyls, unsubstituted or C1 to C16 alkyl-substituted naphtyl moietys can also be used.

Composition of Operating Agent

The operating agent composition generally comprises between 1 and 25% by weight of lubricant—however, this parameter can also be outside of the range indicated, depending on the type of refrigerating machine concerned—preferably at least 40% by weight, preferably at least 80% of weight of the additives to the operating agent consisting of polyalkylene glycols and/or neopentyl polyols, based on all the constituents of the operating agent.

The proportion of the particularly preferred polyalkylene glycols with at least one aromatic group is preferably at least 20% by weight, particularly preferably at least 40% by weight, in particular at least 80% by weight, based on the proportion of lubricant (i.e. the lubricants without refrigerants and additives) in the operating agent composition.

When using lubricant mixtures of different compound classes, the proportion of neopentyl polyol ester used as lubricant is preferably 20 to 60% by weight, particularly preferably 40 to 60% by weight, based on the proportion of lubricant in the operating agent composition in each case.

Miscibility

With respect to the overall degree of effectiveness, an advantageous solubility behaviour between oil and $CO_2$ is desirable. The behaviour of $CO_2$ regarding the solubility properties is highly variable.

The polyalkylene glycols used in the compositions according to the invention are preferably miscible (soluble) for higher proportions by mass of lubricant in $CO_2$ over the entire temperature range from the critical temperature $T_k$ to less than −40° C. and in some cases to less than −55° C. With lower proportions of lubricants, these polyalkylene glycols are no longer or only partially miscible (soluble) with liquid carbon dioxide.

Investigations of air conditioning circuits operated with $CO_2$ have shown that, due to the high miscibility of polyol ester lubricants, such as pentaerythritol esters in particular, a correspondingly high solubility can be achieved.

Connected therewith, a dramatic decrease in the viscosity can take place in the region of the driving gear parts, to be lubricated, of the cryogenic compressor. Under the conditions prevailing there, immiscible or less satisfactorily miscible lubricants such as e.g. mineral oils, polyolefins, alkyl benzenes or even polyalkylene glycols, on the other hand, do not exhibit the above-mentioned decrease in viscosity. However, as a result of the unsatisfactory miscibility, problems arise regarding the oil return transportation, particularly in the expansion valve and evaporator components as well as the suction line, particularly at low flow rates. On the one hand, one of the requirements is to achieve a correspondingly high mixture viscosity in the compressor, i.e. in the clearance filled by the oil film, on the other hand, a miscibility must be guaranteed at low temperatures in the range of the evaporator and suction line components to guarantee the oil return and a good thermal transfer as well as a good controllability of the system.

A so-called partial miscibility, i.e. a miscibility gap existing within a certain temperature range for certain mixing ratios, is of great interest here. Due to the advantageous temperature/solubility behaviour, refrigerating machines can be used in this case which operate without an oil sump or oil recycling.

Preferably, the lubricant according to the invention exhibits a complete miscibility with the operating agent in the concentration range between greater than 0 and 20% by weight, preferably greater than 0 and 5% by weight of the lubricant in the refrigerant at temperatures of 15° C. and less (as low as −40° C., preferably −55° C.) and in the concentration range of 30 and 60% by weight in the relevant temperature range of −40° C. (or −55° C.) to +30° C. Outside these ranges, i.e. between greater than 5 and lower than 30% by weight, greater than 20 and lower than 30% by weight of lubricant in the refrigerant, a miscibility gap is preferably present.

The above-mentioned criterion is e.g. that of polyalkylene glycols closed by terminal C1-C4 alkyl groups produced by using starting alcohols exhibiting aryl groups. Examples in this respect are cresols, p-hexyl phenol or (hydroxymethyl) benzene. Such polyalkylene glycols are defined in further detail in the sub-claims.

Experimental Part

The proven methods for testing the wear behaviour and the load bearing capacity of refrigerating machine oils, e.g. the Shell® "Four ball apparatus" (FBA), the "Almen Wieland testing machine" and the "Falex pin and Vee block test" are suitable only to a limited extent since the influence of compressed $CO_2$ cannot be simulated in this case.

Wear tests carried out with $CO_2$ at 1 bar did not give any direct indications of a strongly negative effect of $CO_2$ on the wear behaviour. Investigations with the block-on ring" testing machine at 10 bar $CO_2$, on the other hand, have shown a distinct influence of the basic oils and, in particular, of additives, on the wear behaviour (D Drees; J Fahl; J Hinrichs; "Effects of $CO_2$ on Lubricating Properties of Polyolesters and Polyalkylene Glycols"; Proc. 13$^{th}$ Int. Colloq. Synth. Lubricants and Operations Fluids, Esslingen 2002, Publication in preparation).

In contrast to test runs with conventional refrigerating machine oils, the bearings exhibited an excellent wear profile after experiments with the compositions according to the invention.

To assess the long term lubrication properties under the influence of compressed $CO_2$, useful life tests were carried out in specifically designed anti-friction bearing test stands under near practical conditions. Finally, several development products were tested in prototype compressors and test facilities. In a long term test stand, the useful life actually achieved was possible under specific operating conditions under a $CO_2$ atmosphere of axial cylinder roller bearings at speeds up to 8000 $min^{-1}$ under a $CO_2$ pressure of 50 bar at a maximum temperature of 90° C. The axial load was 8 kN.

The basis of calculation commonly used for dimensioning of bearings takes into account neither the influence of different basic fluids nor the effect of additives but is based mainly on the mixture viscosity. Important influential factors such as the presence of gases, e.g. $CO_2$ in this particular case, are not included in this calculation even though these play an important part. In order to obtain details in this respect, tests of the useful life are necessary under near practical conditions.

The test parameters are selected in such a way that an optimum test period is achieved for the investigation. The test parameters are summarised in Table 1.

The axial loading of the axial cylinder roller bearings to be examined (geometry AXK 18×35×4.5) is effected via cup-spring assemblies and can be adjusted by means of separator disks of different thickness. The test is carried out until at least one bearing fails as a result of being damaged. The test parameters are as follows:

TABLE 1

Tests parameters

| Parameter | Abbreviation (unit) | Value |
|---|---|---|
| Axial loading | Pa (N) | 8000 |
| Hertz pressure (roller) | Pmax ($N/mm^2$) | 1622 |
| Speed | N ($min^{-1}$) | 800 |

TABLE 1-continued

| Tests parameters | | |
|---|---|---|
| Parameter | Abbreviation (unit) | Value |
| $CO_2$ pressure | P (bar) | 50 |
| Oil temperature | T oil (° C.) | 90 |

The oils shown in table 3 were tested. ND 8 is a commercial product from the Japanese compressor manufacturer NIPPONDENSO (manufactured by Idemitsu Kosan) with, among other things, approximately 1-2% by weight of tricresyl phosphate and 0.5% by weight of BHT (2,6-di-tert.butyl-4-methyl phenol) added. SP10 and SP 20 are commercial products from the Japanese compressor manufacturer SANDEN (also manufactured by Idemitzu Kosan) with similar additives.

The polyalkylene glycol lubricating oils preferably show (P4), even without an addition of phosphoric acid esters a lubrication behaviour corresponding to the terminally methylated polyalkylene glycol added (compare PAG—oil ND 8). The results in table 2 clearly show that the claimed addition in combination with the claimed basic liquids considerably prolongs the useful life under the effect of compressed $CO_2$. This effect is particularly noticeable also in association with highly soluble neopentyl polyol esters.

For the application of $CO_2$ in motor cars, axial piston machines are preferred because of their compact design and the homogeneous conveying streams. During initial endurance tests with prototype compressors, the lubrication of the roller bearing subject to extreme stress, in particular, proves to be problematic. The test runs with the commercial polyol esters and polyalkylene glycol oils resulted in much shorter useful life. As a result of the favourable solubility characteristics and the excellent load bearing capability under the influence of near critical $CO_2$, the claimed formulations are suitable for use as high performance lubricants for $CO_2$ motor car air conditioning and heat pump systems.

In the case of the phosphate ester additives which are easily commercially available, a distinction is made between those comprising cresol (additive C in Table 3) and those comprising xylenol groups (used rarely). The subject matter of the invention consists of t-butylated (additive A in Table 3) and/or isopropylated (additive B in Table 3) triphenyl phosphates. Surprisingly enough, these have proved to be much more suitable than conventional tricresyl phosphate or triphenyl phosphate.

TABLE 2

Basic oil measurement values with and without additive

| Name | Type | Starting components: Monomer | Starting alcohol/ group | End group | Molecular weight (g/mole) | Density (kg/m³) | Kinematic viscosity (mm²/s) | | Viscosity index | Pour point | Useful life L (h) | Added (h) | | |
|---|---|---|---|---|---|---|---|---|---|---|---|---|---|---|
| | Polyether | EO:PO | | | (ca.) | 15° C. | 40° C. | 100° C. | — | (° C.) | — | A | B | C |
| ND8 | PAG | 0:1 | Me | Me | 930 | 992 | 42.3 | 9.2 | 212 | −36 | | | | 61 |
| SP 20 | PAG | 1:1 | Me | Me | 1300 | 1019 | 100.9 | 19.8 | 221 | −45 | | | | 105 |
| SP 20 | PAG | 1:1 | Me | Me | 900 | 998 | 47.6 | 10.2 | 210 | −45 | | | | 90 |
| P1 | PAG | 0:1 | Butanol | OH | 930 | 990 | 58.9 | 11.4 | 191 | −45 | 46 | 156 | 134 | 52 |
| P2 | PAG | 1:1 | Me | Me | 1015 | 1038 | 59.4 | 13.4 | 235 | −51 | 54 | 183 | 167 | 61 |
| P3 | PAG | 0:1 | Furfurol | Me | 930 | 993 | 41.3 | 9.4 | 219 | −51 | 31 | 202 | 156 | 85 |
| P4 | PAG | 1:1 | Phenol | Me | 940 | 995 | 44.0 | 7.3 | 129 | −42 | 60 | 492 | 380 | 144 |
| P5 | PAG | 2:1:1 THF:EO:PO | Butanol | OH | 772 | 981 | 47.2 | 11.5 | 248 | −57 | 40 | (66) | 80 | 64 |
| | Ester | Alcohol | Acid | | | | | | | | | | | |
| E1 | POE | DPE | i-$C_g$ | | 1150 | 974 | 170.0 | 17.2 | 108 | −30 | 22 | 194 | 204 | 71 |
| E2 | POE | DPE | n-$C_g$/ n-C | | 730 | 1006 | 80.0 | 9.9 | 105 | −39 | 17 | 161 | 153 | 45 |

DPE = Dipentaerythritol,
ND8, SP 20 and SP 10 are commercial products with several additives from Nippondenso and Sanden, all other samples comprise no additive, unless otherwise indicated.

TABLE 3

| Additives | | |
|---|---|---|
| # | Additive | P Content |
| A. | t-butylated triphenyl phosphate | 8 |
| B. | isopropylated triphenyl phosphate | 8 |
| C. | tricresyl phosphate | 8.4 |

The invention claimed is:

1. Operating agent composition comprising (A) carbon dioxide as refrigerant, (B) polyalkylene glycols and/or neopentyl polyol esters as lubricant and (C) a phosphate ester with the following structure:

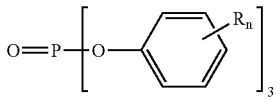

wherein

R optionally, identically or differently for each of the three phenyl moieties and optionally, identically or differently for each n, represents H one or more C1 to C6 hydrocarbon moieties and n optionally identically or differently for each of the three phenyl moieties represents an integer of 1 to 5, with the proviso that for at least one of the three phenyl moieties R is t-butyl and/or isopropyl.

2. Operating agent composition according to claim 1 comprising said phosphate ester in a quantity of 0.1 to 3% by weight, based on the lubricant.

3. Operating agent composition according to claim 1 characterized in that said polyalkylene glycols comprise no free hydroxy groups.

4. Operating agent composition according to claim 1, characterized in that said operating agent composition comprises polyalkylene glycols which, based on the polymer chain and the alkylene oxide monomer units used, consists of essentially exclusively monomer units of the type —(—CH($CH_3$)—$CH_2$—O—)— or —(—$CH_2$—CH ($CH_3$)—O—)—, 20 to 80% monomer units of the type —(—CH($CH_3$)—$CH_2$—O—)— or —(—$CH_2$—CH ($CH_3$)—O—)— and for the remaining residue of monomer units of type —($CH_2$—$CH_2$—O—)— or 20 to 80% monomer units of the type —(—CH ($CH_2CH_3$)—$CH_2$—O—)— or —(—$CH_2$—CH ($CH_2CH_3$)—O—)— and for the remaining residue of monomer units of type —(—$CH_2$—$CH_2$)—O—)—.

5. Operating agent composition according to claim 1, characterized in that said operating agent composition comprises polyalkylene glycols and/or their mixtures having a number average molecular weight of 200 to 3000 g/mole.

6. Operating agent composition according to claim 1, characterized in that said polyalkylene glycols comprise aryl groups or heteroaromatic groups which may optionally be substituted with linear or branched alkyl groups or alkylene groups.

7. Operating agent composition according to claim 1, characterized in that said polyalkylene glycols have the following end groups -alkyl, aryl, alkylaryl, aryloxy, alkoxy, and/or alkylaryloxy end groups having 1 to 24 carbon atoms.

8. Operating agent composition according to claim 1, characterized in that said operating agent composition comprises esters or an ester mixture, wherein said esters are obtainable by reacting neopentyl polyols, with linear and/or branched C4 to C12 carboxylic acids, optionally with an addition of C4 to C12 dicarboxylic acids.

9. Operating agent composition according to claim 1, characterized in that the operating agent comprises neopentyl polyol esters and polyalkylene glycols.

10. Operating agent composition according to claim 1, characterized in that said operating agent composition comprises at least 10% by weight of said polyalkylene glycols and said neopentyl polyesters, based on all the constituents of said operating agent.

11. Operating agent composition according to claim 1, characterized in that said operating agent consists predominantly, apart from said phosphate esters and said refrigerant, of said polyalkylene glycols and said neopentyl polyesters; based on the proportion by weight.

12. Operating agent composition according to claim 1, characterized in that the operating agent additionally comprises a diphenyl amine, a di(C1 to C16 alkyl) phenyl amine as antioxidant and/or a diphenyl amine in which one or two phenyl groups have been exchanged for naphthyl groups.

13. Operating agent composition according to claim 1, characterized in that said phosphate ester has at least for one of said phenyl moieties, an R which is tert-butyl and/or isopropyl.

14. Operating agent composition according to claim 1 for use in refrigerating machines.

15. Operating agent composition according to claim 1 for use in freezing equipment having evaporation temperatures of less than −30° C., wherein lubricants are used which comprise more than 90% by weight of neopentyl polyol esters.

16. Operating agent composition according to claim 1 for use in air conditioning equipment of cars, wherein lubricants are used which comprise more than 90% of polyalkylene glycols.

17. Operating agent composition according to claim 5, wherein said polyalkylene glycols and/or their mixtures have a number average molecular weight of 400 to 2000 g/mole.

18. Operating agent composition according to claim 6, wherein the alkyl groups or alkylene groups have a total of 1 to 24 carbon atoms.

19. Operating agent composition according to claim 8, wherein said neopentyl polyols comprise pentaerythritol, dipentaerythritol and/or tripentaerythritol.

20. Operating agent composition according to claim 11, wherein said operating agent consists exclusively, apart from said phosphate esters and said refrigerant of said polyalkylene glycols and said neopentyl polyesters.

21. Operating agent composition according to claim 14 wherein said refrigerating machine is in a motor vehicle.

* * * * *